United States Patent [19]

MacDonald, Jr.

[11] Patent Number: 4,470,236

[45] Date of Patent: Sep. 11, 1984

[54] VERTICAL BOARDING

[76] Inventor: Milton H. MacDonald, Jr., 5 Holly St., Woodsville, N.H. 03785

[21] Appl. No.: 376,528

[22] Filed: May 10, 1982

[51] Int. Cl.[3] ..... E04B 1/66

[52] U.S. Cl. ..... 52/394; 52/539; 52/521

[58] Field of Search ..... 52/403, 539, 394, 309.13, 52/593, 595, 543, 521

[56] References Cited

U.S. PATENT DOCUMENTS

| | | | |
|---|---|---|---|
| 3,474,584 | 10/1969 | Lynch | 52/593 |
| 3,557,503 | 1/1971 | Snyder | 52/403 |
| 4,292,776 | 10/1981 | MacDonald | 52/403 |

FOREIGN PATENT DOCUMENTS

| | | | |
|---|---|---|---|
| 3041179 | 5/1981 | Fed. Rep. of Germany | 52/539 |
| 2370154 | 7/1978 | France | 52/403 |
| 6917140 | 11/1969 | Netherlands | 52/593 |
| 8005792 | 5/1982 | Netherlands | 52/593 |

*Primary Examiner*—John E. Murtagh
*Assistant Examiner*—Kathryn L. Ford
*Attorney, Agent, or Firm*—Pearson & Pearson

[57] ABSTRACT

An upstanding side wall comprises wood plank members having opposite planar outwardly facing vertical surfaces. The longitudinal side edges are bifurcated symmetrically with respect to a vertical central plane bisecting the two planar surfaces. The bifurcations are curved in horizontal cross-section to form a pair of curved tongues with an intermediate concave curved recess between the tongues. Each recess receives a mating tongue of an adjacent vertical plank member. Each member is symmetrical about the central plane and also about a midplane perpendicular to the central plane and midway between the bifurcations. Alternate members may comprise members corresponding substantially to a half of such a member cut along the central plane. A low density soft foam sealant is applied in a groove at the bottom of each recess.

7 Claims, 6 Drawing Figures

VERTICAL BOARDING

BACKGROUND OF THE INVENTION

The present invention relates to vertical boarding and to an improved upstanding side wall of a building formed of such vertical boarding.

It has heretofore been proposed to provide tongue and groove joints in horizontal wood siding as in my U.S. Pat. No. 4,292,776 of Oct. 6, 1981.

Cladding or sheathing for walls, roofs or floors, formed of boards joined together with tongues and grooves is also disclosed in German Pat. No. DE 3041-179 with a date of disclosure of May 14, 1981.

However, as far as I am aware, it has not been proposed to provide vertical boarding with vertically extending tongue and groove joints having a set of boards of predetermined thickness, and a pair of curved tip tongues separated by concave curved recesses on each vertical side edge which are alternated with vertical boards of half thickness having a single such curved tip tongue on each vertical edge fitting in the recess of the adjacent board to form a wall. The prior art is not believed to disclose such an assembly in which the boards are attached to horizontal supports by nailing through the tongues of the tongue and groove joints into horizontal supports.

SUMMARY OF THE INVENTION

Briefly, this invention comprises an upstanding wall of vertical boarding employing members having opposite planar outwardly facing vertical surfaces. The longitudinal edges of such members are bifurcated symmetrically with respect to a vertical central plane bisecting the two outward planar surfaces. These curved bifurcations form a pair of curved tongues with an intermediate curved concave recess between the tongues. Each recess receives a matching tongue of a shape conforming to the tongues of the bifurcation. The members are symmetrical both with respect to the central plane and with respect to a plane perpendicular to the central plane and midway between the bifurcated edges.

BRIEF DESCRIPTION OF THE DRAWING

The various objects, advantages and novel features of the invention will be more fully understood from the following detailed description when read in connection with the accompanying drawing in which like reference numerals refer to like parts and in which:

Referring to FIG. 1A, a conventional vertical boarding suggested in the prior art may comprise, for example, elements 5 each rabbetted to an adjacent like element. These members have opposite parallel outwardly facing faces 6 and 7, and rabbetted ends 8 with extensions 8 fitting the adjacent undercut portions of the next, like element, in which the outwardly facing faces are reversed, so that first one face is a weather face, and then for the adjacent element face 6 of the outwardly facing faces is a weather face exposed to the elements. These members have the advantage of symmetry, but sealing the extensive rabbetted edges affords problems.

FIG. 1B illustrates a vertical boarding using elements 9 which are simply rectangular and abutted edge to edge with outwardly facing faces 10 and 11, but using the well-known batten construction 12 to seal the edges. The problems of this batten construction and sealing are well-known to the industry.

FIG. 1C is a vertical boarding of the ship lap type using elements 13 having opposite planar faces 14 and 15, and rabbetted projections 16 and 17 of each element being adjacent the opposite faces. The various construction problems associated with such a vertical boarding, including sealing, are understood in the art.

Referring to FIG. 2, members 20 are wood planks or boards each having opposite outwardly facing parallel planar faces 21 and 22. The weather faces 22 are exposed to the elements. A central plane 23 lies halfway between planes 21 and 22. On each longitudinal edge of the elements 20 are a pair of projecting convex curved tongues 24 and **24*a*, and between them a curved concave recess 25. The tongues and recess are symmetrical not only with respect to the half-way plane 23 but also with respect to a midplane 23*a* half-way between the edges and perpendicular to plane 23. Thus the members 20 are each symmetrical and may be faced either way to expose face 21 or face 22** to the weather as indicated.

Figures 1A, 1B, 1C, 2, 3, 4:
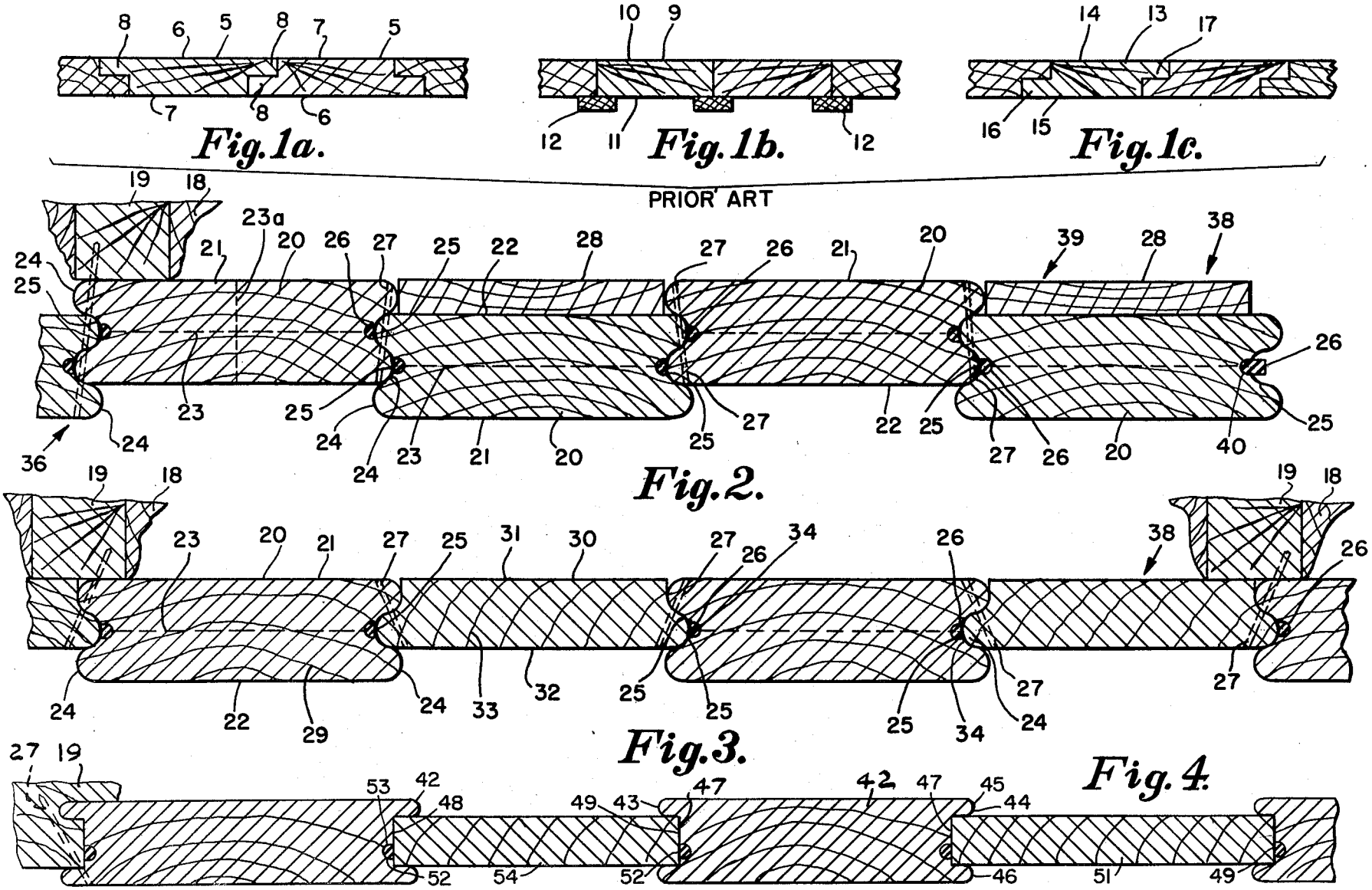
Fig. 1c. PRIOR ART
FIG. 1A, 1B and 1C are transverse, cross section views, in a horizontal plane or prior art conventional, board and batten and ship lap vertical boarding respectively.
FIG. 2 is a transverse cross-sectional view in a horizontal plane of one embodiment of a wall of the vertical boarding of the invention.
FIG. 3 is a transverse cross-sectional view in a horizontal plane of a wall formed by another embodiment of the vertical boarding of the invention.
FIG. 4 is a view similar to FIG. 3 of another embodiment of the invention.

In constructing a wall 36 with the members 20 as illustrated in FIG. 2, each member is placed vertically to receive a tongue conforming to the shape of the recess, which is one of the tongues 24 of alternate members 20. Thus, one member 20 is placed against the backing surface, such as a cross-member 18 or a stud 19, an adjacent member 20 has its inside face 21 or 22 and its inward tongue inserted into the concave recess 25, and then nailed in place such as by nails 27 against the studding 19, or against a cross member 18. To fill the gaps 38 between alternated members 20 a spacer such as spacers 28 may be used to form a flush, uninterrupted surface 38. The next adjacent member 20 is then placed with its outward tongue 24 fitted into the concave recess 25, but requires no spacer 28. The member is similarly nailed into place again using nails 27. Preferably the nails are driven through the two tongues and the interfitted tongue from the adjacent member 20 being put in place, so that the nails are preferably driven through three tongues. The nails are driven in near the outer surface so as to be nearly or completely concealed. Other nailing may include nailing the first member in the recess, and then nailing the recess to receive the next adjacent member; and thereafter nailing through the exposed recess on one side only of each piece as applied, finish pieces being treated specially. This practice would conceal substantially all the nails in the recesses.

A low density sealant 26 such as a soft foam, adhesive strip is applied in a longitudinally extending groove 40 in the base of each tongue recess 25 to make the wall air tight. Also, if the wood expands and exerts a sideways thrust, the sealant receives the thrust and thus prevents cupping, splitting, or distortion of the wall.

Referring to FIG. 3, members 20 are employed like those of FIG. 2. Alternate members 30 have outwardly facing opposite vertical planar sides 31 and 32, and opposite edges have projecting single tongues 34 which are designed to interfit into the recesses 25. It will be recognized that the members 30 are essentially half-members which have a half-recess 24, and are substantially like members 20 divided along the central plane 23. A wall 41 formed with the alternate vertical boarding members 20 and 30 requires no spacers 28, is somewhat less costly of material and the manner of construction will be apparent from FIG. 3 and what has been said theretofore. The vertical rib and groove surface of walls 36 and 41 is attractive to the observer.

In applying vertical boarding as in FIG. 2 or FIG. 3 just described, it is not necessary to stop at a nailing cross member. The ends can be rabbetted and joined with screws. The embodiments of FIGS. 2 and 3 have a similar external appearance. Note also that a slanted cut to accommodate roof boards does not result in any appreciable waste, as the cut piece may be turned end for end and side to side and used.

Because of the variations in depth, the vertical boarding affords to view a pleasing texture, which may be supplemented, if desired, by causing one of the surfaces 21 to be rough cut and the other surfaces 22 to be finished. Then because of the symmetry, the two surfaces may be alternated, i.e., first use a smooth surface for the weather side exposed to view, and then a rough surface, then a smooth, alternately, or in any other desired sequence, thus supplementing the natural textured appearance created by the alternately indented surfaces. In the embodiment of FIG. 3, it is contemplated that the half-members 30 will come rough on the surface 32 exposed to view, and thus provide the alternating rough and smooth appearance. Other sequences are obviously available.

The vertical plank boarding 20 or 30 may be manufactured, for example in eight inch widths, providing 7½ inches to the weather for the outer protruding member of FIGS. 2 or 3, and 6½ inches to view of the indented member. Members 20 may be about 1⅛ inches thick and members 30 about ¾ inch thick.

The members may be applied with the graining 29 of the members 20 of FIG. 2, or the graining 29 and graining 33 of FIG. 3, running downward, as indicated, to provide better water shedding and water resistance and so a longer lasting wall, than if oriented differently.

Thus, there has been described a novel wall 36 of vertical boarding which is economical of material, requires no sheathing or inner covering, is easy of application, and also may provide attractive texture and surface appearance.

The soft foam sealant 26 is waterproof and commercially available in fifty foot rolls and it is unrolled into a groove 40 with about half its thickness seated in the groove and the other half projecting from the groove. Thus the sealant does not compact over 50 percent and is enabled to expand and contract while sealing the joint between members 20 or 30.

As shown in FIG. 4, a plurality of identical wood boards 42 may be used, each longitudinal edge 43 or 44 being bifurcated to form a pair of curved tip tongues such as 45 and 46 with an intermediate recess 47 therebetween. Each recess such as 47 is shaped and configured to receive one of the longitudinal edges 48 or 49 of a standard wood board 51 of conventional, stock rectangular cross section, such as are inventoried by lumber dealers. Each longitudinal side edge 43 or 44 also includes a longitudinal groove such as 52 in the bottom of its recess such as 47 to receive a low density soft foam sealant 53.

As shown the standard boards, or planks, 51 or 54 each fit between the recesses 47 of a pair of adjacent, spaced apart tongue and recess boards 42.

I claim:

1. An upstanding wall of a building comprising a plurality of elongated wood boards connected by longitudinally extending tongue and groove joints and attached to laterally extending spaced wood supports, said wall characterized by:

a first set of said boards or predetermined width, each having opposite planar inner and outer facing surfaces, each having opposite longitudinal side edges bifurcated symmetrically with respect to a central plane bisecting the two planar surfaces, each bifurcation being curved in cross section to form a pair of identical, integral, curved tongues, separated by an intermediate concave curved recess between the tongues;

and a second set of said boards of predetermined lesser width than said first set each having opposite, planar inner and outer facing surfaces, each having opposite longitudinal side edges curved in cross section to form on each side edge a single integral curved tongue shaped and dimensioned to closely fit in a curved recess of an adjacent board of said first set, and form a tongue and groove joint therewith;

the outer facing planar surfaces of the boards of said first and second set forming an interrupted, discontinuous, surface of alternate ribs and grooves;

the inner facing planar surfaces of the boards of said first and second sets forming a single common planar surface in contact with said supports;

said wall being free of fasteners except for nails, passing through the tongues of said tongue and groove joints into said supports.

2. An upstanding wall as claimed in claim 1 wherein:

the boards of said second set of boards are of substantially half the thickness, between their said inner and outer surfaces, as the thickness between the inner and outer surfaces of the boards of said first set of boards, so as to be substantially of a configuration formed by said boards of said first set divided at said central plane.

3. An upstanding wall as claimed in claim 1 wherein:

each said tongue in the boards of said first and second set is free of sealing grooves, but the tongue receiving recess between the identical tongues of the boards of said first set includes a longitudinally extending groove in the curved bottom thereof and seats about half of a longitudinally extending soft foam sealant with the other half projecting therefrom to be compressed by the tongue in said recess.

4. A combination as specified in claim 1 wherein:

all of said tongues and recesses in all of the boards of said first and second set are equal in width so that all of said boards are reversible.

5. A combination as specified in claim 4 wherein:

each board of each said set has its inner face rough cut and its outer face finished;

whereby such surfaces can be alternated by reversing alternate boards in said wall to supplement said interrupted discontinuous surface of alternate ribs and groove with a varied textured appearance.

6. An upstanding wall of a building formed of horizontal supports and a first and second set of vertical boards, each board of the first set being of predetermined thickness and having a pair of integral curved tongues of equal length separated by a central curved recess, adapted to receive a correspondingly shaped curved tongue of an adjacent board, of the second set, extending along each vertical edge thereof:

each board of the second set having at least one said correspondingly shaped curved tongue, identical with the tongues of the boards of the first set, extending along each vertical edge thereof, and received in the recess of an adjacent board of the first set to form tongue and groove joints therewith;

said wall formed by each alternate vertical board of said second set having one of its said curved tongues seated in the curved recess of the next adjacent board of the first set so that each alternate board of one of said sets projects from said wall with the boards between said alternate boards being recessed behind said alternate boards; and said wall being free of fasteners other than nails passing through the tongues at said tongue and groove joints into said horizontal supports.

7. An upstanding wall as claimed in claim 6 wherein:

the tongues of each pair of tongues on each side edge of the boards of said first set and the single tongue on each side edge of the boards of the second set, and the recesses between the pairs of tongues of the boards of said first set are all equal in width, each board of both the first and second set being thereby reversible.

* * * * *